US005273468A

United States Patent [19]

Nichols

[11] Patent Number: 5,273,468

[45] Date of Patent: Dec. 28, 1993

[54] MARKER BUOY

[76] Inventor: Edward R. Nichols, 1475 Osprey Ave., Naples, Fla. 33962

[21] Appl. No.: 20,381

[22] Filed: Feb. 22, 1993

[51] Int. Cl.[5] ..... B63B 22/16

[52] U.S. Cl. ..... 441/6; 441/26; 441/29

[58] Field of Search ..... 441/1, 6, 11, 20, 21, 441/23-26, 28, 29, 3

[56] References Cited

U.S. PATENT DOCUMENTS

| | | | |
|---|---|---|---|
| 1,993,974 | 3/1935 | McVicker | 441/25 |
| 3,037,217 | 6/1962 | Mandra | 441/20 |
| 3,084,354 | 4/1963 | Lunenschloss | 441/11 |
| 3,755,836 | 9/1973 | Milazzo | 114/209 |
| 4,443,203 | 4/1984 | Maertens | 441/22 |
| 4,601,126 | 7/1986 | Klocksiem | 441/16 |
| 4,976,641 | 12/1990 | D'Amico | 441/23 |
| 5,073,135 | 12/1991 | Parks | 441/6 |

*Primary Examiner*—Sherman Basinger
*Attorney, Agent, or Firm*—Merrill N. Johnson

[57] ABSTRACT

A marker buoy for marking a particular spot on the bottom of the sea despite heavy seas. The buoy includes a hollow cylindrical chamber whose outer surface forms a spool. A length of line is attached to the chamber and wound around the spool with an anchor attached to the free end of the line. An elongated hollow tube is attached in axial alignment to one end of the cylindrical chamber. A cored foamed polystyrene ball whose diameter is slightly greater than the diameter of the cylindrical chamber is slidably mounted on the elongated tube. A cap affixed to the free end of the tube prevents the floatable ball from sliding off the tube. The buoy is placed on the surface of the water with the axes of the chamber and tube parallel to the water's surface. Small holes in the chamber gradually fill with water as the line runs out following the descending anchor. The water filling the chamber causes the buoy to tip, locking the line in a notch in the side of the spool, and as the water fills the chamber the buoy assumes an upright position supported by the hollow tube and floating ball.

4 Claims, 1 Drawing Sheet

MARKER BUOY

BACKGROUND AND SUMMARY OF THE INVENTION

My invention relates to floating buoys used to mark the position of an underwater feature such as a reef, a sunken wreck or a deep depression in the sea floor inhabited by schools of fish.

Many fishermen use floating buoys to mark locations that they believe to contain an abundance of fish. Normally the markers, whether homemade or purchased from stores selling fishermen's supplies, consist of a pair of floatable hollow balls connected by a hollow cylinder, with a line connected and wound onto the hollow cylinder. The other end of the line is connected to a lead weight or similar anchoring means.

When the fisherman wishes to mark a given location, he places the marker on the surface of the water directly over the location. The weight of the anchoring means causes the floating balls to rotate as the line runs out until the anchoring means reaches the sea bottom. But strong tidal currents, winds and waves tend to move the floating buoy often resulting in the anchoring means being torn loose from the sea bottom and thus the floating buoy no longer accurately marks the location of the undersea feature.

As the captain of a chartered Florida fishing boat for 25 years, I have examined a number of patents proposing various designs for marker buoys such as U.S. Pat. Nos. 3,755,838; 4,443,203; 4,601,125; 4,976,641 and 5,073,135, but so far as I am aware no buoy presently on the market or shown in the prior patents for marking undersea fishing spots will remain in position over the fishing spot in high winds or heavy seas.

I have designed, constructed and tested in the Gulf of Mexico a marker buoy which remains in position despite high winds and heavy seas. My marker buoy includes a hollow cylindrical chamber with a pair of parallel spaced apart flat annular edged flanges projecting from the outer wall of the chamber to form a spool and an axially positioned annular flange at one end of the chamber. An elongated hollow cylindrical tube is securely fastened into the annular flange of the chamber and a cored floatable ball preferably of foamed polystyrene is slidably mounted on the tube. A cap is affixed to the end of the tube to prevent the ball from sliding off the tube.

A line preferably about 200 feet in length and made of nylon is fastened to the cylinder and wound around the spool between the two parallel flanges of the chamber and a weight preferably in the form of a 1 ½ pound Danforth anchor is secured to the free end of the nylon line.

A series of sea water entry holes and air vent holes are drilled in the walls of the cylindrical chamber.

My marker buoy is placed on the surface of the water directly above the undersea spot to be marked with the axis of the chamber and tube parallel to the water's surface where the buoy floats on the ball and chamber. As the anchor descends toward the sea bottom the unwinding line causes the chamber to rotate until the anchor hits the bottom. As the chamber begins to fill with water, its weight causes the buoy to tip and the line is trapped and locked in position within a notch in the annular edge of lower flange of the spool. This prevents the line from further unwinding and fixes the position of the buoy closely adjacent the undersea spot intended to be marked.

The chamber, now underwater, continues to fill with sea water until the buoy assumes a vertical position rather than its original horizontal position on the surface of the water. The hollow tube and its floatable ball keep the marker in sight on the surface of the sea, with the ball sliding up and down on the tube acting as a shock absorber which prevents wave action, high winds or heavy seas from tearing the anchor loose from the sea bottom and moving the entire marker buoy away from its intended location.

DESCRIPTION OF A PREFERRED EMBODIMENT OF THE INVENTION

Figure 1:
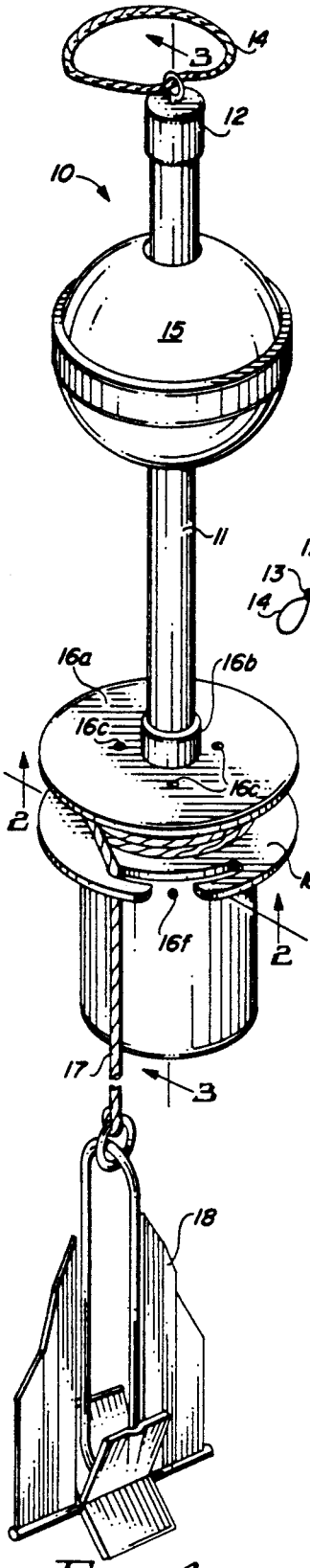
FIG. 1 is a perspective view of a preferred embodiment of my marker buoy shown with its anchor descended and its line locked in position.

As shown in the drawings, marker buoy 10 includes a hollow cylindrical chamber 16 preferably cast of polyvinyl chloride (PVC) with a pair of flat annular-edged flanges 16*a* and 16*d* projecting from the upper portion of chamber 16 and forming between the two flanges a spool.

Cylinder 16 also contains an axially aligned cylindrical flange 16*b* into which is fitted elongated hollow tube 11 also preferably made of PVC and firmly joined to flange 16*b* by a conventional glue.

Figure 3:
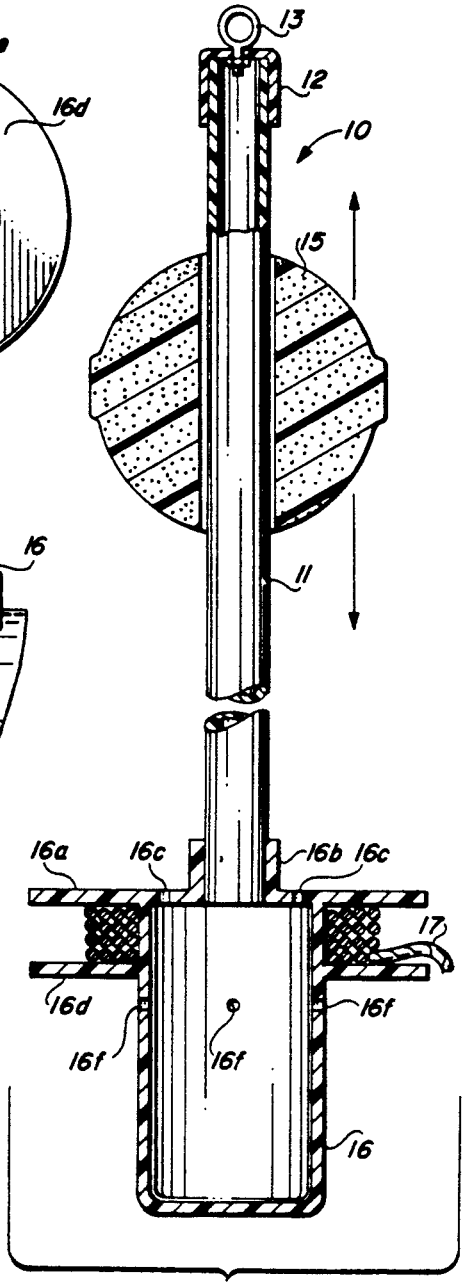
FIG. 3 is a cross-sectional side view of the marker buoy taken along line 3—3 of FIG. 1.
Figure 5:
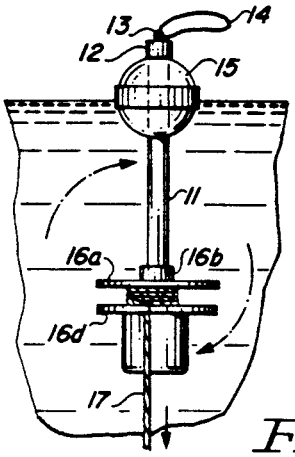
FIG. 5 is a diagrammatic view of my marker buoy after the anchor has reached the sea bottom, its chamber has filled with water, its line is locked in position and the buoy has turned 90° from its original horizontal position to a vertical position supported on the surface of the water by its slidable floating ball.

Chamber 16 has preferably four water-entry holes 16*c* in the upper end of the chamber equally spaced around axial flange 16*b*. The chamber also has preferably four air vent holes 16*f* equally spaced around the middle of chamber 16 as best shown in FIG. 3. The function of these water-entry holes 16*c* and air vent holes 16*f* will be explained hereinafter.

Figure 2:
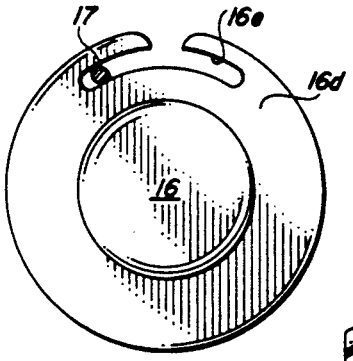
FIG. 2 is a cross-sectional bottom view of the marker buoy taken along line 2—2 of FIG. 1.

Lower flange 16*d* includes a single notch 16*e* in its annular edge. As best shown in FIG. 2 notch 16*e* preferably contains a pair of oppositely extending slots designed to trap and hold line 17 in a fixed position so that the line cannot further unwind.

A floatable ball 15 is preferably made of foamed polystyrene and cored to fit slidably onto tube 11. A cap 12 is firmly affixed to the upper end of tube 11 to prevent ball 15 from sliding off the upper end of the tube.

A ring 13 is mounted on cap 12 and contains an endless line 14 which is used to recover the marker buoy from the sea.

Approximately 200 feet of nylon line 17 is wound upon the spool between flanges 16*a* and 16*d* with one end of the line secured to chamber 16. An anchoring means preferably a ½ pound Danforth anchor 18 is affixed to the other end of line 17.

Figure 4:
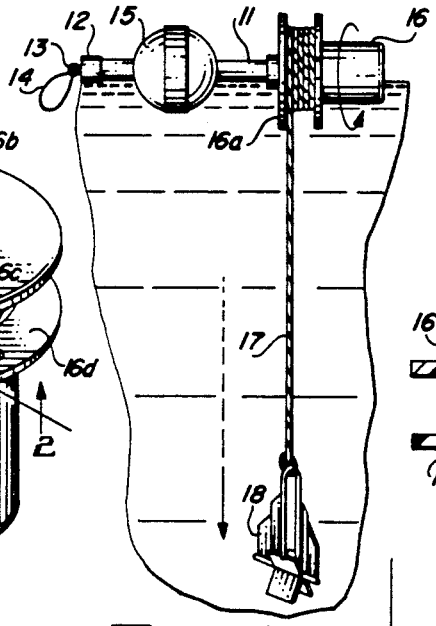
FIG. 4 is a diagrammatic view of my marker buoy as it is placed on the surface of the water and the buoy rotates on the surface of the water as the line is unwound by the descending anchor.

When the fisherman locates a fishing spot he wishes to mark, he places the marker buoy 10 onto the surface of the water in a horizontal position as shown in FIG. 4. Anchor 18 drops toward the sea bottom and buoy 10 rotates as line 17 unwinds.

As chamber 16 is rotating, its holes 16*b* and 16*f* admit some water into hollow chamber 16. Once anchor 18 hits the sea bottom, chamber 16 ceases to rotate and the chamber rapidly fills with water and sinks beneath the surface. As the axis of the buoy turns from horizontal to vertical, line 17 is caught by and locked in place within notch 16*e* so the line cannot further unwind.

Line 17 now having a fixed length between the anchor buried in the sea bottom and chamber 16, my buoy accurately marks the fishing spot. The hollow tube 11 and styrofoam ball 15 combine to keep the buoy afloat.

In the event of heavy seas, ball 15 slides up and down on the tube 11 as the buoy rides the waves, acting like a shock absorber which prevents the anchor from being torn loose from the sea bottom.

I have tested the operation of my marker buoy in sea with waves of seven feet in the Gulf of Mexico. In no case has the anchor of my marker buoy moved from its original intended position.

While I have shown and described a preferred embodiment of my marker buoy, various modifications will be apparent to those skilled in the art without departing from the spirit and scope of my invention. The scope of my invention is limited only by the appended claims.

I claim:

1. A marker buoy for continuously marking a particular location on the bottom of a body of water despite heavy seas which includes:

a hollow cylindrical chamber having a central axis, said chamber including an upper and a lower flat annular-edged flange spaced apart and projecting from the chamber to form a spool, an elongated hollow tube axially aligned with and affixed to one end of the chamber, a floatable ball slidably mounted on the elongated tube, a cap on the other end of the tube which prevents the ball from sliding off that end of the tube, a length of line wound upon the spool with one end fastened to the spool, anchoring means attached to the free end of the line, the lower flange on the chamber including a notch in its annular edge for trapping the line in a fixed position after the anchoring means reaches the bottom of the body of water, and a plurality of water entry holes and air escape holes in the chamber which function after the anchoring means reaches the bottom of the body of water causing the chamber to fill with water and sink beneath the surface of the water and reposition the tube from lying parallel to the surface of the water to a vertical position with the ball floating on the surface of the water, whereby the ball sliding up and down on the tube acts like a shock absorber which prevents the anchoring means from being pulled loose from the bottom despite heavy seas which would otherwise move the buoy from its original position.

2. A marker buoy as set forth in claim 1 in which the line is 200 feet long and the anchoring means is a ½ pound Danforth anchor.

3. A marker buoy as set forth in claim 1 in which the chamber is 4 inches in diameter and 7 inches in length and the tube is 1 ¾ inches in diameter and 24 inches in length.

4. A marker buoy as set forth in claim 1 in which the ball is made of foamed polystyrene and is 7 ½ inches in diameter.

* * * * *